US005585769A

United States Patent [19]

Mazzochette

[11] Patent Number: 5,585,769

[45] Date of Patent: Dec. 17, 1996

[54] PASSIVE TEMPERATURE VARIABLE PHASE-SHIFTER

[75] Inventor: Joseph B. Mazzochette, Cherry Hill, N.J.

[73] Assignee: EMC Technology, Inc., Cherry Hill, Pa.

[21] Appl. No.: 514,970

[22] Filed: Aug. 14, 1995

[51] Int. Cl.[6] ..... H01P 1/18

[52] U.S. Cl. ..... 333/156; 333/161; 333/81 R

[58] Field of Search ..... 333/81 A, 81 R, 333/109, 116, 156, 161, 128

[56] References Cited

U.S. PATENT DOCUMENTS

| | | | |
|---|---|---|---|
| 2,836,798 | 5/1958 | Le Vine | 333/128 |
| 4,398,161 | 8/1983 | Lamb et al. | 333/156 |
| 4,581,595 | 4/1986 | Silagi | 333/156 X |
| 4,639,697 | 1/1987 | Yarranton et al. | 333/155 |
| 4,788,509 | 11/1988 | Bahl et al. | 330/54 |
| 5,019,793 | 5/1991 | McNab | 333/156 |
| 5,332,981 | 7/1994 | Mazzochette et al. | 333/81 R |
| 5,349,312 | 9/1994 | Huettner et al. | 333/81 A |

*Primary Examiner*—Benny Lee
*Assistant Examiner*—Justin P. Bettendorf
*Attorney, Agent, or Firm*—Donald S. Cohen

[57] ABSTRACT

A temperature variable phase-shifter formed of passive components. The phase-shifter includes a power divider which is adapted to receive a signal and divide the signal into two components which are 90° out of phase with each other. The outputs of the power divider are connected to positive and negative temperature variable attenuators which attenuated the components of the signal. The temperature variable attenuators are connected to a combiner which sums the attenuated signals from the temperature variable attenuators.

11 Claims, 2 Drawing Sheets

PASSIVE TEMPERATURE VARIABLE PHASE-SHIFTER

FIELD OF THE INVENTION

The present invention relates to a passive temperature variable phase-shifter, and, more particularly, to a passive circuit which compensates for phase variations resulting from changes in temperature.

BACKGROUND OF THE INVENTION

Many electrical components used in electric circuits suffer from parametric variation as a result of changes in ambient temperature. These parameters include resistance, inductance and capacitance in passive circuits, and gain, distortion, and noise in active circuits. In both active and passive devices parametric changes can produce changes in phase. For example, considering the low pass filter 10 shown in FIG. 1 which comprises a resistor 12 and capacitor 14 connected in series along a line between ports 16 and 18. The phase shift from port 16 to port 18 will change as the value of the resistor 12 varies with temperature. If the resistance of the resistor 12 is 2 ohms, the phase at 1500 Mhz is −2.7°, while if the resistance is 50 ohms the phase is −10°. The phase shift will similarly change as the capacitance of the capacitor 14 varies with temperature.

Another common circuit element that suffers from phase variation with temperature is the delay line. Delay lines are used to produce signal propagation delays in radar and communication systems. Delay lines are often produced by coiling coaxial transmission lines. A typical coaxial line will have a phase variation of about −100 ppm/° C. If many such components are used in a complicated device, such as a multistage amplifier or filter, the resulting phase variation with temperature can be large.

Many active devices are available to compensate for phase variations including digital step phase shifters, and analog phase shifters. The step type phase shifter switches in or out discrete phase shifts such that the sum equals the desired total shift. The analog type phase shifter creates four mutually orthogonal vectors and then varies the magnitude of each to form a single recombined vector at the desired phase. However, in each of these types of phase shifters additional temperature sensors and drives would be required to use these devices for temperature compensation. Active devices have the additional problems of size, complexity, reliability, DC power consumption, cost and the introduction of distortion and switching transients as a result of the nonlinear control devices.

SUMMARY OF THE INVENTION

The present invention is directed to a passive temperature variable phase-shifter which includes means for dividing a signal into orthogonal vectors. The circuit also includes means for attenuating the vectors using complementary positive and negative temperature variable attenuators, and means for summing the attenuated vectors. The phase-shifter of the present invention uses only passive devices so as that there is no introduction of distortion, DC supply drain or switching transients. Also, the passive devices reduce the complexity of the circuit so as to increase reliability and cut the size and cost of the phase-shifter.

DETAILED DESCRIPTION

Figure 1:
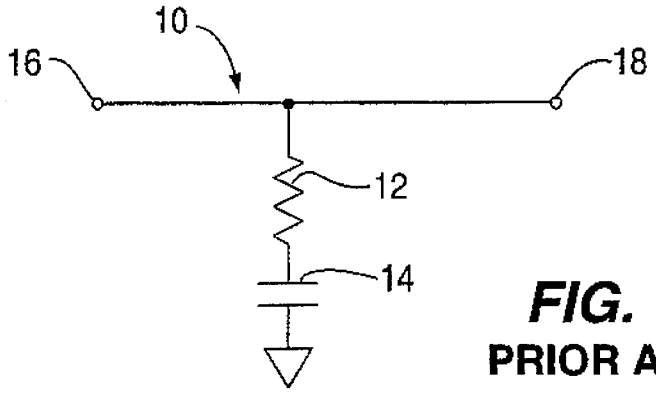
FIG. 1 PRIOR ART
FIG. 1 is a circuit drawing of a typical low pass filter known in the prior art.
Figure 2:
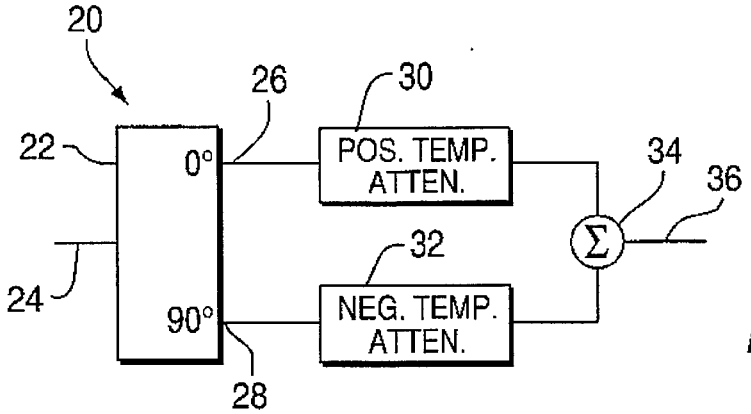
FIG. 2 is a circuit drawing of the temperature variable phase-shifter in accordance with the present invention.

Referring initially to FIG. 2, a temperature variable phase-shifter in accordance with the present invention is generally designated as 20. Phase-shifter 20 comprises a power divider 22 which divides a signal into inphase and orthogonal components. The power divider 22 has an input 24 for receiving the input signal and a pair of outputs 26 and 28. The inphase component of the signal exits the output 26 and the orthogonal component exits the output 28. A positive temperature variable attenuator 30 is connected to the inphase component output 26 and a negative temperature variable attenuator 32 is connected to the orthogonal component output 28. An inphase combiner 34 is connected to both the positive temperature variable attenuator 30 and the negative temperature variable attenuator 32. The combiner 34 has an output line 36.

The temperature variable phase-shifter 20 operates by first dividing an input signal which is fed into the power divider 22 into two signals, one of which is in phase with the input signal and the other which is out of phase with the input signal by 90°. The inphase component of the signal is fed into the positive temperature variable attenuator 30 and the orthogonal signal is fed to the negative temperature variable attenuator 32. The attenuators 30 and 32 attenuate their respective components of the signal. The attenuated components of the signal are then summed by the combiner 34. The summed vector is shifted in phase, relative to the input signal, by the temperature coefficient of phase (TCP) which is determined by the selection of the positive and negative temperature attenuators 30 and 32.

Figure 3:
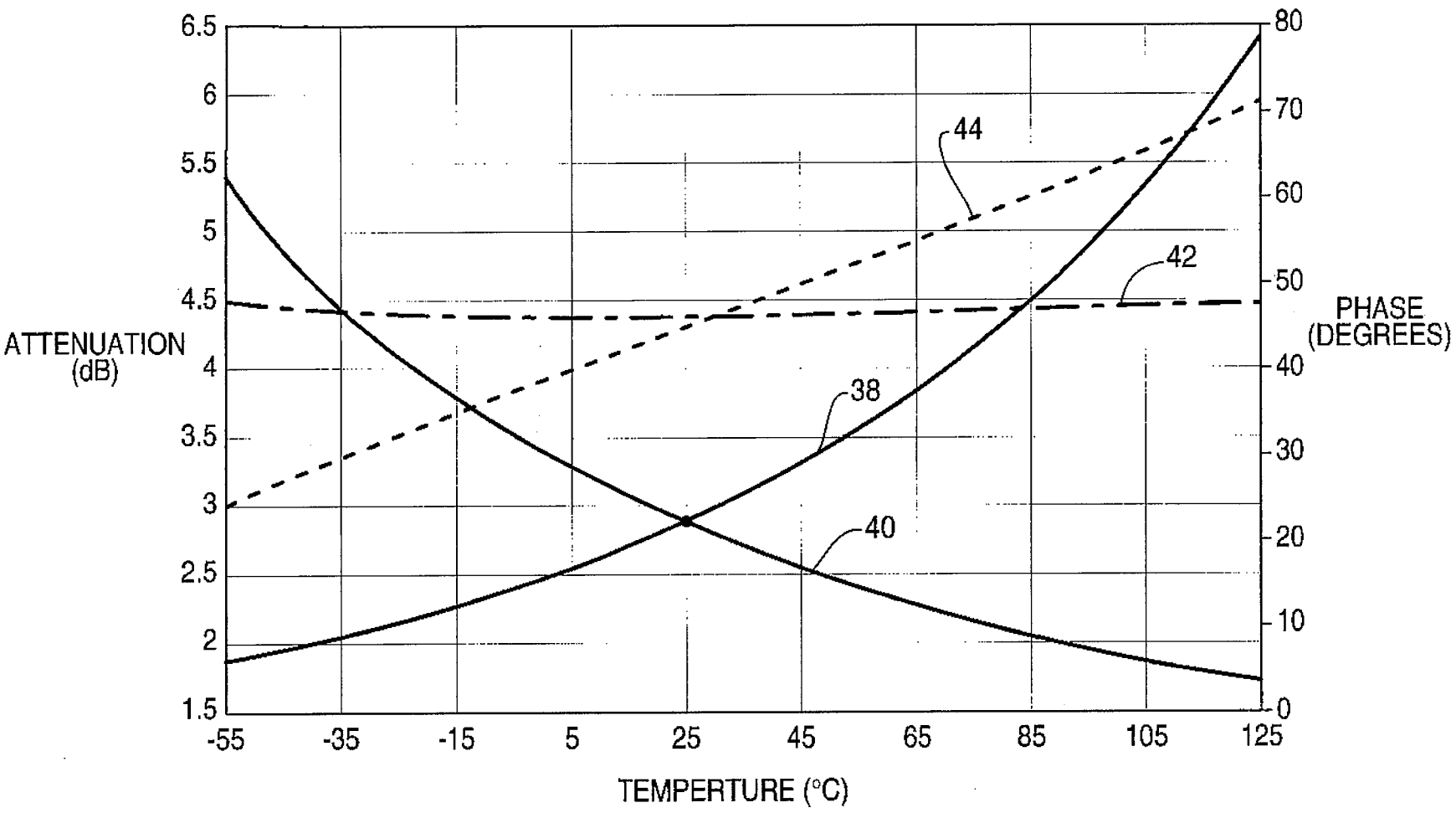
FIG. 3 is a graph showing the operating conditions of the phase-shifter of the present invention.

Referring to FIG. 3, there is shown a graph of the response of the temperature variable phase-shifter 20 having temperature variable attenuators 30 and 32 with a 3 dB nominal value and a positive TCA of +0.007 dB/dB/° C. and a negative TCA of −0.007 dB/dB/° C. The temperature variable attenuator curves 38 and 40 are for the positive and negative shifting temperature variable attenuators respectively. The summed responses are identified as the amplitude curve 42 and the phase curve 44. As can be seen from this graph, the amplitude stays substantially constant over temperature, while the phase changes linearly with a positive slope. A negative slop can be achieved by interchange the positive and negative temperature attenuators 30 and 32. The magnitude of the slope can be changed by changing the TCA of the two temperature variable attenuators. The linearity of the phase curve and the level of the ripple in the amplitude curve depend on how closely the two temperature attenuators 30 and 32 compliment each other.

Figure 4:
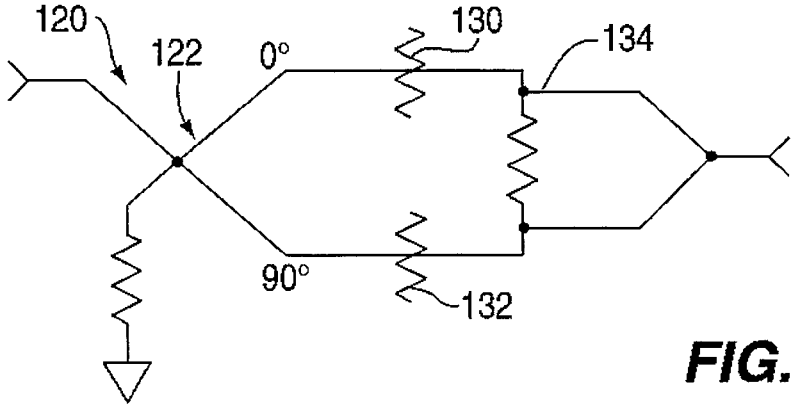
FIG. 4 is a circuit drawing of the details of one form of the phase-shifter of the present invention.

Referring to FIG. 4, one specific form of the temperature variable phase-shifter of the present invention is generally designated as 120. The temperature variable phase-shifter 120 comprises a power divider 122 which is a quadrature coupler. The quadrature coupler 122 may be produced using an interdigital (Lang), branch line, microstrip or stripline broadside, twisted wire coaxial, lumped element (ferrite balun type) or any number of other 90° coupler devices. The power divider is connected to positive and negative temperature variable attenuators 130 and 132, which may be of the type shown in U.S. Pat. No. 5,332,981 to J. B. Mazzochette et al., issued Jul. 26, 1994, entitled TEMPERATURE VARIABLE ATTENUATOR. The positive and negative temperature variable attenuators 130 and 132 are connected to an in-phase combiner 134, which may be a Wilkinson combiner or a lumped element type. The temperature variable phase-shifter 120 operates in the manner described above and can be made to operate over multiple octaves. However, this circuit suffers from the insertion loss of the particular power divider 122.

Figure 5:
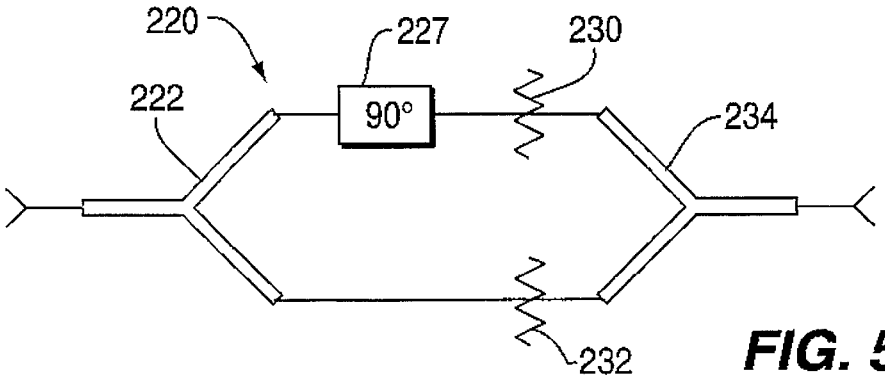
FIG. 5 is a circuit drawing of the details of another form of the phase-shifter of the present invention.

Referring to FIG. 5, another specific form of the temperature variable phase-shifter of the present invention is generally designated as 220. Temperature variable phase-shifter 220 comprises a power divider 222 of the inphase lossless type, which may be a lumped element (ferrite balun type) transmission line (microstrip, stripline, coaxial, etc.) type. One output 226 of the power divider 222 is fed into a 90° phase shifter 227 which is fed into a positive temperature variable attenuator 230. The other output 228 of the power divider 222 is fed into a negative temperature variable attenuator 232. The positive and negative variable attenuators 230 and 232 may be of the type shown and described in U.S. Pat. No. 5,332,981 to J. B. Mazzochette et al., issued Jul. 26, 1994, entitled TEMPERATURE VARIABLE ATTENUATOR. The positive and negative temperature variable attenuators 230 and 232 are fed into a combiner 234, which is a device similar to the power divider 222 but in reverse. The temperature variable phase-shifter 220 uses a narrow band approach with lossless power dividers. However, the power divider 222 changes the impedance of the transmission line from 50 ohms to 100 ohms so that the temperature variable attenuators 230 and 232 must have a 100 ohm impedance.

Thus, there is provided by the present invention a phase-shifter the output of which is compensated for changes in temperature. The phase-shifter is a completely passive circuit and is simple in design and reliable in operation.

What is claimed is:

1. A temperature variable phase-shifter comprising:

means for dividing a signal into orthogonal vectors;

means for attenuating the vectors using complementary positive and negative temperature variable attenuators; and means for summing the attenuated vectors.

2. The phase-shifter of claim 1 in which the means for dividing the signal into orthogonal vectors comprises a power divider which divides the signal into an inphase component and a component which is 90° out of phase with the signal.

3. The phase-shifter of claim 2 in which the power divider is a quadrature coupler.

4. The phase-shifter of claim 2 in which the power divider is a lossless power divider which divides the signal into two separate components.

5. The phase-shifter of claim 4 in which the power divider includes a lossless power divider and a 90° phase-shifter connected to one of the outputs of the lossless power divider.

6. The phase-shifter of claim 2 in which the power divider has a pair of outputs with one of the outputs being connected to a positive temperature variable attenuator and the other output being connected to a negative temperature variable attenuator.

7. The phase-shifter of claim 6 in which the means for summing the attenuated vectors comprises a combining coupler.

8. The phase-shifter of claim 7 in which the combining coupler has a pair of inputs and each of the temperature variable attenuators is connected to a separate one of the inputs of the combining coupler.

9. A temperature variable phase-shifter comprising:

a power divider having an input and a pair of outputs, the power divider adapted to divide an input signal into orthogonal components;

a positive temperature variable attenuator connected to one of the outputs of the power divider;

a negative temperature variable attenuator connected to the other output of the power divider; and a combining coupler having an output and a pair of inputs, each of the temperature variable attenuators being connected to a separate one of the inputs of the combining coupler, the combining coupler adapted to sum the attenuated signals from the temperature variable attenuators.

10. The phase-shifter of claim 9 in which the power divider is a quadrature coupler which is adapted to divide the input signal into an inphase component and a component which is 90° out of phase.

11. The phase-shifter of claim 9 in which the power divider includes a lossless power divider which is adapted to divide the input signal into two components and a 90° phase shifter connected to one of the output of the lossless power divider.

* * * * *